United States Patent [19]

Simkovich et al.

[11] 4,151,012

[45] Apr. 24, 1979

[54] HIGH STRENGTH, CORROSION RESISTANT TUBULAR PRODUCTS AND METHODS OF MAKING THE SAME

[75] Inventors: Ales Simkovich, Ligonier Township, Westmoreland County; Leonard A. Pugliese, Murrysville, both of Pa.

[73] Assignee: Latrobe Steel Company, Latrobe, Pa.

[21] Appl. No.: 786,491

[22] Filed: Apr. 11, 1977

[51] Int. Cl.[2] ..... C21D 9/14

[52] U.S. Cl. ..... 148/11.5 N; 29/421 E; 138/177

[58] Field of Search ..... 148/11.5 N, 171, 32, 148/4; 72/56; 29/421 E; 138/177

[56] References Cited

U.S. PATENT DOCUMENTS

| | | | |
|---|---|---|---|
| 2,703,297 | 3/1955 | MacLeod | 29/421 E |
| 3,172,199 | 3/1965 | Schmidt | 29/421 E |
| 4,026,583 | 5/1977 | Gottlieb | 29/421 E |

*Primary Examiner*—M. J. Andrews

*Attorney, Agent, or Firm*—Buell, Blenko & Ziesenheim

[57] ABSTRACT

Tubular metal products and methods of making tubular metal products for use in sour gas wells, which are characterized by resistance to hydrogen sulfide embrittlement at temperatures up to about 600° F., are provided based upon an alloy having the composition up to about 0.035% maximum carbon, up to about 0.15% maximum silicon, up to about 0.15% maximum manganese, up to about 0.010% maximum sulfur, up to about 0.015% maximum phosphorus, about 19.0% to about 21.0% chromium, about 33.0% up to 37.0% nickel, about 9.0% to about 10.5% molybdenum, up to about 1.00% titanium, up to about 0.015% boron, up to about 2% iron and the balance cobalt, said tubular product having been strengthened by explosive shock loading which may be followed by heat treatment to further strengthen the tubular product. A small amount of cold work between the explosive shock strengthening treatment and heat treatment may be used to control the size and shape of the product and provide additional strengthening if needed. This same practice may be applied to other alloys of the nickel-base, iron-nickel base, cobalt-nickel base, cobalt base and iron-nickel-cobalt base groups which are responsive to cold working to produce higher strengths and reduce sulfide stress cracking.

18 Claims, 3 Drawing Figures

HIGH STRENGTH, CORROSION RESISTANT TUBULAR PRODUCTS AND METHODS OF MAKING THE SAME

This invention relates to high strength, corrosion resistant tubular products and methods of making the same and particularly to high strength pipe and tube which is resistant to corrosion and to hydrogen sulfide embrittlement at elevated temperatures.

There are known deposits of natural gas amounting to many trillions of cubic feet which are found at great depths and are highly contaminated with hydrogen sulfide and carbon dioxide in a chloride solution environment. These deposits, generally known as "sour gas" deposits, are usually located at depths up to 6 miles, at temperatures up to 600° F. Attempts to recover this gas have generally proven to be both uneconomical and very dangerous. Ordinary steel well casing and tubing is destroyed in hours, in many cases, in this hostile environment. Moreover, the gas is extremely toxic and a failure in the handling pipe or tube which permits escape of the gas above ground can result in almost immediate death to anything coming in contact with it. Attempts have been made to solve this problem using various compositions of the so-called "superalloys" without success. Here, again, the hostile environment of chloride solution, high temperature, carbon dioxide and hydrogen sulfide causes failure of the pipe or tubing in a very short time either from corrosion or as a result of embrittlement.

We have discovered that the alloy known in the trade as MP35N which is used to produce high strength fasteners, etc. when cold worked and aged at 1100° F. can, by a totally different treatment, not heretofore used or recognized, be formed into tubular products which have high strength and will retain their integrity in the hostile environment of a sour gas well. We have discovered that an alloy of the broad composition:

| | |
|---|---|
| C | up to about 0.035% max. |
| Si | up to about 0.15% max. |
| Mn | up to about 0.15% max. |
| S | up to about 0.010% max. |
| P | up to about 0.015% max. |
| Cr | about 19.0% to about 21.0% |
| Ni | about 33.0% to about 37.0% |
| Mo | about 9.0% to about 10.5% |
| Ti | up to about 1.0% |
| B | up to about 0.015% |
| Fe | up to about 2% |
| Co | Balance |

may be treated as hereafter described to produce tubular products which are compatible with the hostile environment of sour gas wells.

The preferred analysis of alloy for use in our invention is:

| | |
|---|---|
| C | up to about 0.020% max. |
| Si | LAP (lowest possible amt.) |
| Mn | LAP (lowest possible amt.) |
| S | LAP (lowest possible amt.) |
| P | LAP (lowest possible amt.) |
| Cr | about 20.50% |
| Ni | about 35.25% |
| Mo | about 9.80% |
| Ti | about 0.75% |

-continued

| | |
|---|---|
| B | about 0.010% |
| Fe | LAP (lowest possible amt.) |
| Co | Balance |

We have discovered that such alloys if subject to explosive shock loading to strengthen the desired product and then heat treated, will withstand hydrogen sulfide embrittlement and yet have high strength. We have also found that the alloy can be cold worked following explosive strengthening to improve product geometry or increase strength or both and then heat treated while still obtaining the unusual properties here sought.

The ability of a tubular member to withstand hydogen sulfide embrittlement and failure in sour gas wells is usually measured by a C-ring sulfide stress cracking test. This test is performed by cutting a C-shaped ring of the alloy being tested, drilling opposing holes in the walls of the C-ring and inserting a bolt through the holes carrying a carbon steel shim which extends half way around the C-ring with its free end spaced from the center of the C-ring to form a crevice about ⅛ inch away from the center of the C-ring. A nut is tightened on the bolt to stress the C-ring and the ring is inserted in a standard NACE solution (National Association of Corrosion Engineer's solution) composed of oxygen free water containing 5% sodium chloride, 0.5% acetic acid and saturated with $H_2S$, simulating the sour gas well environment. A galvanic cell is formed between the steel shim and C-ring. The C-ring is then checked periodically for cracking. Ordinary carbon steel tubing and all alloys presently known, with their existing treatments, fail this test in a matter of hours to a few days at high strength levels. This is true of the MP35N alloy described above when treated in the usual manner for production of high strength articles. However, when treated according to this invention, the alloy is markedly improved in C-ring properties.

The marked improvement obtained by this invention is illustrated in the following examples and the drawings in which.

Figure 1:
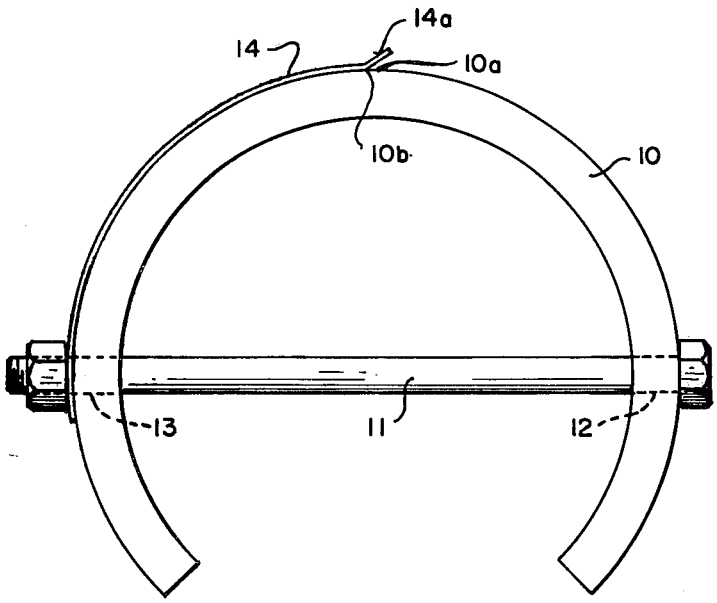
FIG. 1 shows a specimen for C-ring testing.
Figure 2:
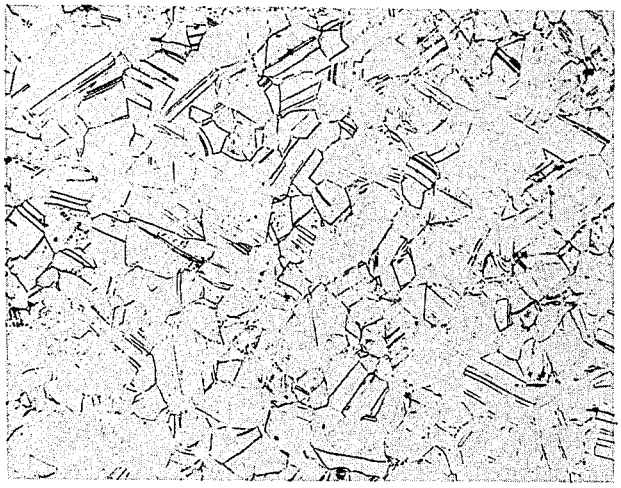
FIG. 2 shows a photomicrograph of a longitudinal section through a tube, unaged, prepared according to this invention.
Figure 3:
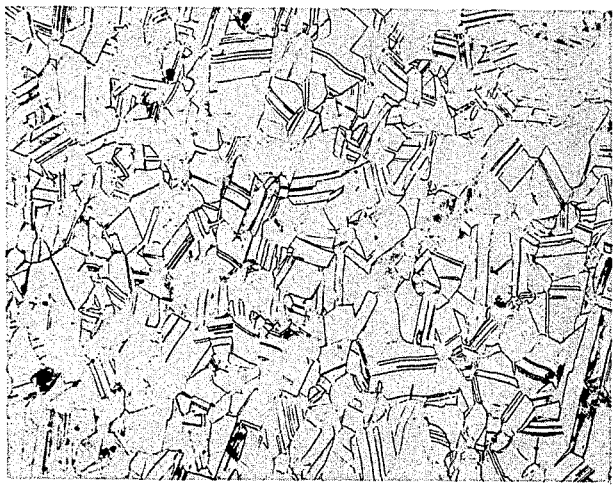
FIG. 3 shows a photomicrograph of a transverse section through the tube of FIG. 2.

Referring to FIG. 1, we have illustrated a C-ring 10 made of the test alloy and having a bolt 11 of the same material extending through holes 12 and 13 on the opposite ends of the C member 10. A carbon steel shim 14 is fixed at one end on bolt 11 and encircles the C member 10 to its mid-point **10*a* at which point the free end 14*a* of shim 14 forms a crevice at 10*b* about ⅛ inch away from mid-point 10*a*** and forms a galvanic cell when the assembly is immersed in the NACE solution.

EXAMPLE I

Four annealed 3½" O.D.×0.250"×12" length tubes made of the preferred composition set out above were explosive shock strengthened at peak shock pressures from about 150,000 to about 500,000 lbs. per square inch (p.s.i.). Tensile properties from each shock strengthened tube were obtained on unaged and 1100° F. aged (2, 4 and 8 hours) specimens. The results of these tests appear in Table I.

TABLE I

Room Temperature Tensile Properties
Explosive Shock Strengthened MP35N Tubes - 3½" O.D. × 250" Wall

| Tube No. | Peak Pressure (k.s.i.) | Aging Treatment | UTS (k.s.i.)* | 0.2% YS (k.s.i.) | El. (%) | RA (%) | Hardness ($R_c$) |
|---|---|---|---|---|---|---|---|
| 1 | 150 ± 30 | None | 122.6 | 66.6 | 59.4 | 71.9 | 10.0 |
| | | 1100° F./2/AC | 124.1 | 61.5 | 62.5 | 76.6 | 10.7 |
| | | 1100° F./4/AC | 126.9 | 67.8 | 54.7 | 93.5 | 11.5 |
| | | 1100° F./8/AC | 125.4 | 62.8 | 71.9 | 80.0 | 10.3 |
| 2 | 300 ± 50 | None | 131.0 | 83.7 | 53.1 | 70.4 | 17.0 |
| | | 1100° F./2/AC | 130.8 | 82.1 | 56.3 | 74.1 | 17.7 |
| | | 1100° F./4/AC | 131.0 | 81.9 | 54.9 | 75.4 | 17.5 |
| | | 1100° F./8/AC | 131.8 | 82.7 | 51.6 | 76.6 | 20.0 |
| 3 | 250 ± 50 | None | 130.8 | 80.2 | 56.2 | 71.1 | 17.0 |
| | | 1100° F./2/AC | 130.3 | 76.5 | 57.8 | 76.6 | 17.5 |
| | | 1100° F./4/AC | 129.6 | 76.4 | 84.4 | 78.3 | 17.5 |
| | | 1100° F./8/AC | 129.3 | 76.4 | 54.7 | 80.3 | 16.8 |
| 4 | 500 ± 50 | None | 139.3 | 104.5 | 56.2 | 71.1 | 25.0 |
| | | 1100° F./2/AC | 142.9 | 102.0 | 43.8 | 65.3 | 25.3 |
| | | 1100° F./4/AC | 141.0 | 103.8 | 42.2 | 61.0 | 25.0 |
| | | 1100° F./8/AC | 139.2 | 102.8 | 42.2 | 65.5 | 25.7 |
| 5 | | Annealed Properties | 135.0 | 60.0 | 70.0 | 70.0 | 8.0 |

*p.s.i. = k.s.i. × 1,000

Based upon the foregoing results, it is evident that a shock strengthened pressure of 150,000 p.s.i. is ineffective since the tensile properties developed by Tube #1 are similar to annealed tensile properties for MP35N. Increasing the shock strengthened pressure to a maximum of 500,000 p.s.i. increased the tensile yield strength to approximately 104,000 p.s.i.

EXAMPLE II

Two annealed 3½" O.D.×0.250" wall×12" length tube samples were explosive shock loaded to isotropically strengthen MP35N tubing. Each tube was subjected to a peak explosive strengthening pressure of 750 k.s.i. for variable impulses (impulse equals area under curve of a plot of explosive pressure vs. time.) Tube #5 had the smaller impulse.

Tensile and hardness test results from Tubes #5 and #7 are shown in Table II. Based on these data, it is evident that increased impulse is effective in strengthening MP35N by explosive shocking.

C-ring tests as described above are underway on sample 7. As of Mar. 31, 1977 these samples have been in test for 66 days without failure.

TABLE II

Room Temperature Tensile Properties
3½"1/2" O.D. × .250" Wall Explosive Shock Strengthened MP35N Tubes, 750 k.s.i. Peak Pressure

| Tube No. | Aging Treatment | UTS (k.s.i.) | 0.2% YS (k.s.i.) | El. (%) | RA (%) | Mid-wall Hardness ($R_c$) |
|---|---|---|---|---|---|---|
| 5 | None | 140.7 | 103.0 | 41.9 | 52.3 | 21.8 |
| | 1100° F./4/AC | 143.3 | 99.5 | 39.1 | 50.7 | 23.4 |
| 7* | None | 179.1 | 174.1 | 20.3 | 48.3 | 36.4 |
| | 1100° F./4/AC | 181.4 | 172.8 | 10.9 | 30.9 | 34.0 |

*Impulse of explosive shock strengthening 3 times greater than Tube #5.

EXAMPLE III

To further increase the strength of explosive shock strengthened MP35N tubing, cold rolling after explosive shocking to develop information on the capabilities of hybrid strengthening techniques was evaluated in this example by shock strengthened a tube according to the parameters used for Tube No. 7 in Table II.

After shock strengthened, the tube sample was quartered longitudinally and the individual quarters were flattened and then cold rolled 0, 10.5%, 22.4% and 33.5%, respectively, using reductions of approximately 5% per pass.

Tensile test results using full wall specimens are listed in Table III.

These data confirm that significant increase in strength can be obtained by combining cold work strengthening with explosive shock strengthening.

TABLE III

Room Temperature Tensile Properties
Explosive Shock Strengthened(1) plus Cold Work Strengthened(2) MP35N Tube #8

| Percent Cold Reduction | Condition | UTS (k.s.i.) | 0.2% YS (k.s.i.) | El. (%) | Mid-Wall Hardness ($R_c$) |
|---|---|---|---|---|---|
| 0 | As Flattened | 150.7 | 130.3 | 33.0 | 34.2 |
| " | Aged 1100° F./4/AC | 156.3 | 135.1 | 26.0 | 34.3 |
| 10.5 | As Rolled | 169.2 | 145.1 | 10.0 | 34.6 |
| " | Aged 1100° F./4/AC | 181.0 | 163.5 | 11.0 | 37.6 |
| 22.4 | As Rolled | 195.8 | 175.5 | 11.0 | 40.0 |
| " | Aged 1100° F./4/AC | 200.9 | 192.0 | 10.0 | 40.0 |
| 33.5 | As Rolled | 190.1 | 164.4 | 10.0 | 43.7 |
| " | Aged 1100° F./4/AC | 225.0 | 215.4 | 10.0 | 43.9 |
| 35 | Unshocked Standard) | 194.0 | 168.3 | 18.0 | — |
| " | Aged 1100° F./4/AC | 197.7 | 176.6 | 19.5 | |

(1)Explosive shock strengthened at 750 k.s.i. peak pressure. Impulse same as for Tube #7 in Table II. Mid-wall hardness, $R_c$ 36.1.
(2)Quartered then flattened and cold rolled ~5% per pass.

The tensile properties of other alloys of the nickel-base, iron-nickel-base, cobalt-nickel base, cobalt base, and iron-nickel-cobalt-base groups, which are responsive to cold working, can be improved by this practice. For example, (1)Hastelloy C-276, (2)Inconel 625, (2)Incoloy 901, (2)Inconel 718 and (3)Elgiloy, among others, are all amenable to this practice to improve their tensile properties and to reduce or eliminate susceptibility to sulfide stress cracking. After explosive shock strengthening the alloys can be further strengthening by cold working and/or heat treating to produce the desired mechanical properties.

(1) Trademark of Cabot Corporation
(2) Trademark of International Nickel Corporation
(3) Trademark of Elgiloy Company, a Divn. of American Gage and Machine Co.

In the foregoing specification, we have set out certain preferred practices and embodiments of our invention, however, it will be understood that this invention may be otherwise embodied within the scope of the following claims.

We claim:

1. A non-laminar tubular metal product for use in sour gas wells characterized by resistance to hydrogen sulfide embrittlement at temperatures up to about 600° F., the entire product consisting essentially of an alloy having the composition up to about 0.035% maximum carbon, up to about 0.15% maximum silicon, up to about 0.15% maximum manganese, up to about 0.010% maximum sulfur, up to about 0.015% maximum phosphorus, about 19.0% to about 21.0% chromium, about 33.0% up to 37.0% nickel, about 9.0% to about 10.5% molybdenum, up to about 1.0% titanium, up to about 0.015% boron, up to about 2% iron and the balance cobalt, said tubular product having been subject to explosive shock strengthening treatment to effect non-directional cold working of the entire body of the tube.

2. A tubular metal product as claimed in claim 1 which has been heat treated after explosive shock strengthening.

3. A tubular metal product as claimed in claim 1 wherein the alloy composition is up to about 0.020% maximum carbon, lowest possible amount of silicon but not more than 0.15%, lowest possible amount of manganese but not more than 0.15%, lowest possible amount of sulfur but not more than 0.005%, lowest possible amount of phosphorus but not more than 0.010%, about 20.50% chromium, about 35.25% nickel, about 9.80% molybdenum, about 0.75% titanium, about 0.010% boron, lowest possible amount of iron but not more than 1% and the balance cobalt.

4. A tubular metal product as claimed in claim 3 which has been heat treated after explosive shock strengthening.

5. A tubular metal product as claimed in claim 1 wherein said product has been cold work strengthened by conventional means after explosive shock strengthening.

6. A tubular metal product as claimed in claim 2 wherein said product has been cold work strengthened after explosive shock strengthening and prior to heat treatment.

7. A tubular metal product as claimed in claim 5 wherein said product has been cold work strengthened sufficiently to improve product geometry or increase strength or both.

8. A tubular metal product as claimed in claim 1 wherein said product has been explosive shock strengthened at peak pressures in the range of about 250,000 to 1,500,000 p.s.i. peak pressure.

9. A tubular metal product as claimed in claim 1 wherein said product has been explosive shock strengthened at peak pressures in the range about 500,000 to 750,000 p.s.i. peak pressure.

10. A method for producing a non-laminar tubular metal product suitable for use in sour gas wells and characterized by resistance to hydrogen sulfide embrittlement at temperatures up to about 600° F. comprising the steps of:

(a) forming a non-laminar tubular metal member entirely from an alloy consisting essentially of up to about 0.035% maximum carbon, up to about 0.15% maximum silicon, up to about 0.15% maximum manganese, up to about 0.010% maximum sulfur, up to about 0.015% maximum phosphorus, about 19.0% to about 21.0% chromium, about 33.0% to 37.0% nickel, about 9.0% to about 10.5% molybdenum, up to about 1.0% titanium, up to about 0.015% boron, up to about 2% iron and the balance cobalt, and (b) explosive shock strengthening said product to effect non-directional cold working of the entire body of the tube.

11. The method as claimed in claim 10 wherein the product is heat treated following explosive shock strengthening.

12. A method as claimed in claim 10 wherein the alloy consists essentially of up to about 0.020% maximum carbon, lowest possible amount of silicon but not more than 0.15%, lowest possible amount of manganese but not more than 0.15%, lowest possible amount of sulfur but not more than 0.005%, lowest possible amount of phosphorus but not more than 0.010%, about 20.50% chromium, about 35.25% nickel, about 9.80% molybdenum, about 0.75% titanium, about 0.010% boron, lowest possible amount of iron but not more than 1% and the balance cobalt.

13. The method as claimed in claim 11 wherein the product is heat treated following explosive shock strengthening.

14. A method as claimed in claim 10 wherein the tubular product is cold work strengthened after explosive shock strengthening.

15. A method as claimed in claim 11 wherein the product is cold work strengthened after explosive shock strengthening and prior to heat treating.

16. A method as claimed in claim 14 wherein the tubular product is cold work strengthened sufficiently to improve product geometry and/or increase strength.

17. A method as claimed in claim 10 wherein the explosive shock strengthening step is carried out in the range of 250,000 to 1,500,000 p.s.i. peak pressure.

18. A method as claimed in claim 10 wherein the explosive shock strengthening step is carried out in the range of about 500,000 to 750,000 p.s.i. peak pressure.

* * * * *

UNITED STATES PATENT AND TRADEMARK OFFICE

CERTIFICATE OF CORRECTION

PATENT NO. : 4,151,012

DATED : April 24, 1979

INVENTOR(S) : Alex Simkovich and Leonard A. Pugliese

It is certified that error appears in the above-identified patent and that said Letters Patent are hereby corrected as shown below:

On the Title Page, after "Inventors:" "Ales" should be --Alex--.

In TABLE II, Column 3, line 47, " 1/2" " (second occurrence) should be deleted.

Signed and Sealed this

Tenth Day of July 1979

[SEAL]

Attest:

LUTRELLE F. PARKER

Attesting Officer

Acting Commissioner of Patents and Trademarks